US010602814B1

(12) United States Patent
Dholakiya

(10) Patent No.: US 10,602,814 B1
(45) Date of Patent: Mar. 31, 2020

(54) PRECIOUS STONE SETTING

(71) Applicant: H.K. Designs Inc., New York, NY (US)

(72) Inventor: Hasmukh H. Dholakiya, New York, NY (US)

(73) Assignee: H. K. DESIGNS INC., New York, NY (US)

( * ) Notice: Subject to any disclaimer, the term of this patent is extended or adjusted under 35 U.S.C. 154(b) by 0 days.

(21) Appl. No.: 16/180,157

(22) Filed: Nov. 5, 2018

(51) Int. Cl.

| | |
|---|---|
| ***A44C 17/02*** | (2006.01) |
| ***A44C 25/00*** | (2006.01) |
| ***A44C 9/00*** | (2006.01) |
| ***A44C 17/04*** | (2006.01) |

(52) U.S. Cl.
CPC ..... *A44C 17/02* (2013.01); *A44C 9/00* (2013.01); *A44C 17/04* (2013.01); *A44C 25/001* (2013.01)

(58) Field of Classification Search
CPC ..... A44C 17/02; A44C 17/04; A44C 17/043; Y10T 29/23
USPC ..... 29/10
See application file for complete search history.

(56) References Cited

U.S. PATENT DOCUMENTS

| | | | | |
|---|---|---|---|---|
| 677,075 A | | 6/1901 | Fuchs | |
| 736,022 A | | 8/1903 | Rhode | |
| 795,109 A | | 7/1905 | Dover | |
| 1,050,935 A | * | 1/1913 | Farnham | A44C 17/02 29/10 |
| 1,649,540 A | * | 11/1927 | Moscini | B23P 5/00 227/153 |
| 1,818,324 A | | 8/1931 | Hamin | |
| 2,058,978 A | | 10/1936 | Hamin | |
| 2,774,231 A | | 12/1956 | Peterson | |
| 4,871,339 A | * | 10/1989 | Sadegh | H01T 21/02 445/7 |
| 5,072,601 A | | 12/1991 | Slowinski | |
| 5,115,649 A | | 5/1992 | Amber | |
| 5,548,976 A | | 8/1996 | Slowinski | |
| 5,649,434 A | | 7/1997 | Itzkowitz | |
| D409,518 S | | 5/1999 | Ho | |
| D480,659 S | | 10/2003 | Pachauer | |
| D485,509 S | | 1/2004 | Shagalov | |
| D498,699 S | | 11/2004 | Shagalov | |
| 8,215,126 B2 | | 7/2012 | Mattar | |

OTHER PUBLICATIONS

Extended European Search Report and Search Opinion dated Nov. 21, 2019 in corresponding European Patent Application No. EP 19 02 0327.

* cited by examiner

*Primary Examiner* — Jack W Lavinder
(74) *Attorney, Agent, or Firm* — Ostrolenk Faber LLP

(57) ABSTRACT

A bezel setting comprises: a bezel body having a circumscribing wall with a given body thickness, an upper surface sized to enable a corresponding pavilion surface of a precious stone to rest thereon, and a bendable lip substantially surrounding the upper surface of the bezel body, the lip having an interior surface shaped to be substantially matched and complementary to an exterior surface defining a girdle surface of the precious stone, and the lip has a thickness dimension that is substantially smaller than said body thickness of said bezel body. The lip is made of a material that is compressible and bendable so it can be bent over to tightly wrap the girdle and slightly cover a crown region of the precious stone.

13 Claims, 6 Drawing Sheets

PRECIOUS STONE SETTING

BACKGROUND OF THE INVENTION

The present invention relates to jewelry settings and to a jewelry setting method for setting diamonds or precious stones and, more particularly, to a setting using a bezel style mounting that reduces to a minimum the portion of the diamond that is overlapped by the bezel, yet preserving the strength and durability of the setting.

In general, techniques for setting diamonds and other precious stones have been known for many centuries. The prior art is reflected in patent documents spanning over a century including U.S. Pat. No. 677,075 which uses a sheet metal ring with an annular series of extending prongs that support the stones. Other U.S. patents include U.S. Pat. Nos. 736,022; 1,818,324; 2,058,978; 2,774,231; D409,518; D480,659; D485,509; and D498,699. The gamut of these patents covers different techniques including various modes of creating grooves on the pavilions of the diamonds and other techniques for mounting diamonds invisibly. The contents of the aforementioned patents are incorporated by reference herein.

Additional prior art patents that describe the background of the invention include U.S. Pat. No. 5,072,601, which relates to a particular type of invisible mounting setting, U.S. Pat. No. 8,215,126, in which diamonds are grooved and mounted in a peculiar way; U.S. Pat. No. 5,649,434, which in turn refers to U.S. Pat. Nos. 5,072,601 and 5,115,649, which focus on square settings where sloped grooves are created into the diamonds. The full contents of the aforementioned patents are incorporated by reference herein.

Thus, the prior art is very familiar with precious stone or diamond mounting techniques that use a "metal housing (mounting)" and techniques which use a prong setting, or a pave setting, or a micro-pave setting, or a channel setting, or a channel prong setting, a nick setting, a bezel setting, a flush setting, and the aforementioned invisible setting techniques.

The object of the present invention is to provide a setting that utilizes the bezel type of the prior art setting, but in an improved construction and method of mounting that ameliorates some of the drawbacks of the prior art associated with bezel settings.

In general, in jewelry settings, the bezel, in the case of ring jewelry, occupies a wider and usually thicker section of the hoop, which may contain a flat surface, usually with an engraved design, as in a Signet ring or a gem. The bezel typically holds the stone, i.e., the diamond, in place using a raised surrounding for the diamond with a lip encircling and overlapping the edges of the stone, thus holding the stone in place. In the aforementioned prior art, the band of metal forming the lip contains a groove and a flange to hold the gemstone in the setting.

The present invention is rooted in the realization that in diamond jewelry, the most precious material is the diamond itself. Therefore, it is self-evident that one would strive to have a bezel setting covering over as little as possible of the edges of the diamond. The diamond is an illustrious material and covering up the sparkling material takes away significant value of the piece of jewelry. In addition, in a prior art setting that uses prongs, there is always a concern that during regular use of a jewelry, the prong areas will subject the diamond to scratching, chipping, fracturing or breaking. It is noted that the sharp edges in a cut diamond are located at the bottom tip of the diamond, at the "cullet" and also at the girdle where the diamond has its widest diameter and it begins sloping inward along it pavilion. The girdle is typically thin and is subject to being broken.

In prior art settings, the cullets of the diamonds are relatively protected because they are located deep within the setting and far from being exposed to external forces. This is not so with the girdle of the diamond where damage can more easily occur because of its accessibility.

To appreciate certain drawbacks of the prior art bezel setting methods, reference is made below to prior art FIGS. 1A, 1B, 1C and 1D. In the prior art bezel setting 100 (FIG. 1A), the diamond 120 is located and held in a bezel setting 110 which, as shown in FIG. 1B, has a barrel shaped body 111 with a circumscribing flange 113 the top which is slightly narrower than the width of the overall barrel body 111 and which has a circumscribing peripherally extending notch or undercutting 114.

Typically, during mounting of the diamond 120, the diamond is held with its cullet 122 pointing to the inside of the barrel body 111 and is forcefully pushed into the setting so that that it slightly deforms the lip/flange 113 and then snaps into position so that the girdle 124 of the diamond 120 snaps into the notch 114. The notional bracket 124 (in FIG. 1A) indicates the diameter of the diamond 120 and its relationship to the outer diametrical size of the bezel 110. Indeed, as shown in FIG. 1D, in the prior art bezel setting 110, the portion 126 of the diamond 120 that is visible above the upper surface of the bezel is recessed quite a bit from the peripheral circumferential outer surface of the bezel. This is because the lip/flange 113 has to be quite wide/thick relative to the wall thickness of the body 111, to allow it to deform and snap back to its original shape, when the diamond 120 is being forced into the setting 100.

In the conventional bezel setting method, the bezel wall thickness is about 0.50 to 0.80 mm and some jewelers provide even a greater thickness than 0.8 mm. Also, in the prior art bezel settings, the girdle of the diamond is inserted in the bezel wall to a depth of about 0.10 to 0.20 mm. As a result of the prior art setting methods, the ratio of the visible portion of the diamond to the outer diameter of the metal housing (the mounting) is very low, on the order of about 60 to 77%. Moreover, due to the thick bezel walls around the diamond, the diamond looks considerably smaller than its actual size. The actual percentages of the aforementioned visibility percentages depend on the size of the diamond being mounted and the degree of visibility that is obtained in the prior art is set forth in the table below.

Prior Art "Conventional Bezel Setting"

| Size of Diamond (Girdle Diameter in mm) | Ratio of "Visible Diamond Portion to the Body of Metal Housing (Mounting)" in top view | Diamond Crown visibility % in side view |
|---|---|---|
| 2.0-3.0 mm | 60-65% | 0% |
| 3.0-5.0 mm | 65-70% | 0-25% |
| 5.0-8.0 mm | 70-75% | 25-50% |

SUMMARY OF THE INVENTION

Accordingly, it is an object of the present invention to provide a setting for diamonds and other precious stones that utilizes a bezel setting with improved performance.

It is another object of the present invention to provide a bezel style setting for solitaire and cluster diamond settings that uses the bezel setting in an improved manner that provides the needed sturdiness while exposing a greater area of a diamond for viewing.

The foregoing and other objects of the invention are realized in a bezel style setting that is referred to herein as the seamless bezel setting. In a preferred embodiment, the bezel setting comprises: a bezel body having a circumscribing wall with a given body thickness, an upper surface sized to enable a corresponding pavilion surface of a precious stone, for example a diamond, to rest thereon, and a bendable lip substantially surrounding the upper surface of the bezel body, the lip having an interior surface shaped to be substantially matched and complementary to an exterior surface defining a girdle surface of the precious stone, and the lip has a thickness dimension that is substantially smaller than said body thickness of said bezel body and wherein said lip is made of a material that is compressible and bendable so it can be bent over to tightly wrap the girdle and slightly cover a crown region of the precious stone. Preferably, the diamond has a diametrical size in the range of 2.0 to 8.0 mm and the setting is made of metal, for example gold, silver, steel and the like.

Preferably, the lip has a thickness dimension in the range of 0.1 to 0.2 mm and the lip thickness is about 20% or less of the body thickness of the bezel body. The lip extends over the crown region of the diamond so that it covers less than 2 to 5 percent of the diametrical size of the diamond.

Preferably, the upper surface of the bezel body is inclined downward toward a center of the bezel setting, wherein the angle of inclination of the upper surface is substantially matched to a corresponding angle of the pavilion region of the precious stone so that a portion of the pavilion region of the precious stone rests on the upper surface of the bezel setting and makes contact therewith. Preferably, the angle of inclination is in the range of 41 to 44 degrees relative to a horizontal plane passing through the bezel body, as well as to a table surface of the precious stone when the precious stone is installed in the bezel setting.

A method of setting a precious stone, comprises: providing a bezel setting having a bezel body with a circumscribing wall with a given body thickness, an upper surface sized to enable a corresponding pavilion surface of a precious stone to rest thereon, and a bendable lip substantially surrounding the upper surface of the bezel body, the lip having an interior surface shaped to be substantially matched and complementary to an exterior surface defining a girdle surface of the precious stone, and the lip has a thickness dimension that is substantially smaller than said body thickness of said bezel body and wherein said lip is made of a material that is compressible and bendable so it can be bent over to tightly wrap the girdle and slightly cover a crown region of the precious stone; and bending the lip of the bezel setting so that it tightly contacts the girdle region and slightly overlaps the crown region of the precious stone.

The method may include: providing jig fixture comprising a base and a pressing section; placing the bezel setting with a precious stone placed in the bezel setting in the base of the jig fixture; and pressing the pressing section of the jig fixture onto the base, in a manner that causes the lop of the bezel setting to be bent around and over the girdle and the crown region of the precious stone.

Other features and advantages of the present invention will become apparent from the following description of the invention which refers to the accompanying drawings.

DETAILED DESCRIPTION OF EMBODIMENTS OF THE INVENTION

Figure 1A:
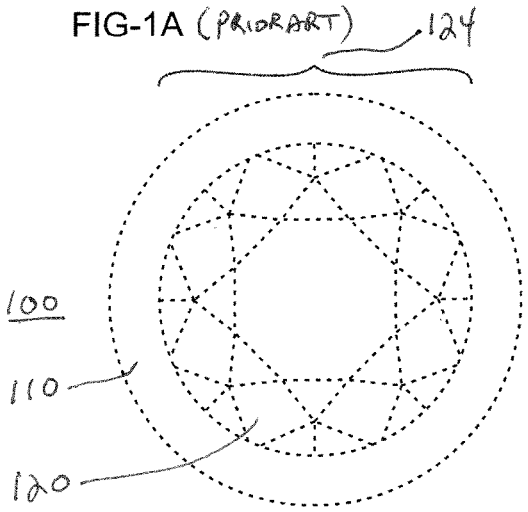
FIG-1A (PRIOR ART)
FIGS. 1A, 1B, 1C and 1D show aspects of prior art bezel settings.

Referring to FIGS. 2A-2D, the novel bezel setting 10 of the present invention comprises an outer barrel style bezel setting 30 which is designed to hold a diamond 20 where the span or diametrical size of the diamond, indicated by the bracket 42, is shown relative to the diametrical span 44 of the setting 30. In the present invention, and as more clearly shown in FIG. 4A, the bezel setting 30 has a basic wall thickness of 0.50 to 0.80 mm (for diamond diameters, ranging from 2.00 to 8.00 mm). This wall thickness 34 becomes very thin, in the range of 0.10 to 0.20 mm, at the lip 37, and when the girdle of the diamond 20 is inserted into the setting, the overlap on the diamond at the girdle and slightly over the crown region, is at a minimal amount, in a range of 0.025 to 0.05 mm. One can appreciate at a glance that in the setting of the present invention, the ratio of the visible portion of diamond to the dimensional size of the metal housing, i.e., the bezel mount, is very high, between 85 to 98%. An additional benefit ensues from the fact that because the lip portion 37 of the bezel is so thin, it is almost invisible to the naked (un-aided) eye when viewing the mounting/setting from a distance. Preferably, the lip 37 has a height of 0.20 to 0.30 mm.

Figure 2A:
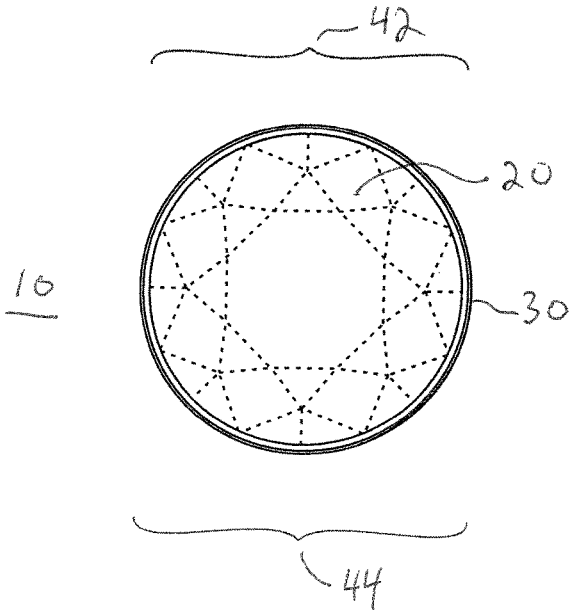
FIGS. 2A, 2B, 2C and 2D illustrate aspects of a bezel setting according to the present invention.
Figure 2B:
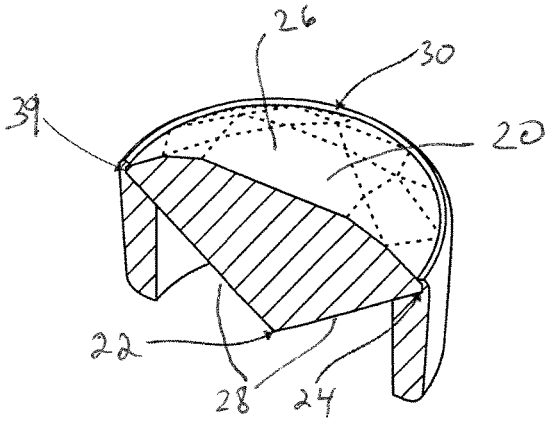
Figure 2D:
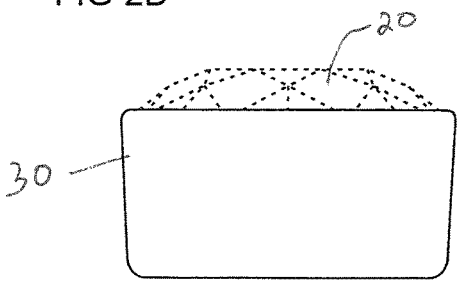
Figure 2C:
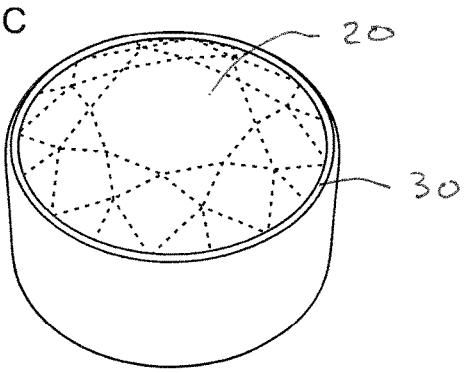

In FIG. 2B, the precious stone 20 is illustrated in cross-section identifying its cullet 22, its downward and inside slanted pavilion 28, its girdle 24 and its table 26. As seen, the girdle is located in the setting to be held by the lip 37 which is a bent over section 39 of the bezel lip 37 (see FIG. 6B). As shown in FIG. 2D, a much greater proportion of the diamond 20 can be seen extending almost to the peripheral edges of the setting 30.

Figure 3:
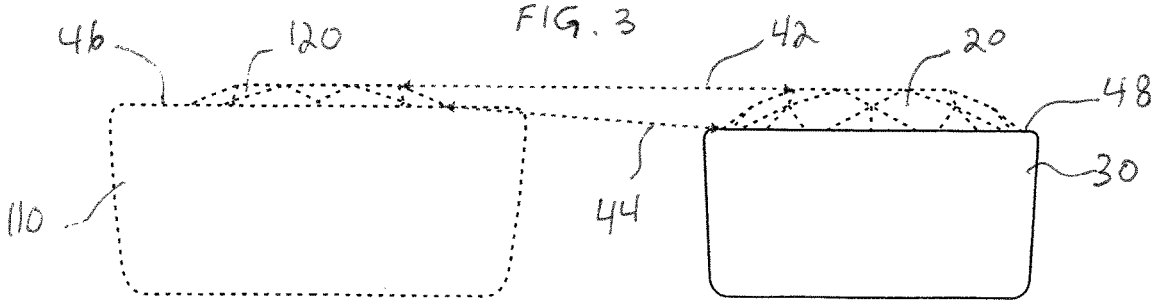
FIG. 3 provides a side by side comparison of a bezel mounting of the prior art as compared to the bezel mounting of the present invention.

FIG. 3 provides a side-by-side rendering of the prior art mounting (at the left side) to the bezel mounting of the present invention (at the right side). As seen, in the prior art, the section that extends beyond the diamond and partially overlaps the diamond, namely the section 46, is orders of magnitude larger than the corresponding section 48 in the setting of the present invention. The connecting lines 42 and 44 also show that the height of the diamond 20 above the upper edge of the setting 30 is considerably greater than in the prior art. The overall effect is to increase the luster of the diamond even though the diamonds, namely the diamond 20 in the present invention and the diamond 120 of the prior art have the same diametrical sizes and other dimensions.

Figure 4A:
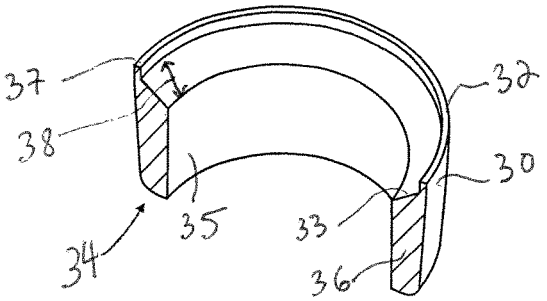
FIGS. 4A, 4B and 4C show further aspects of the bezel setting of the present invention.
Figure 4B:
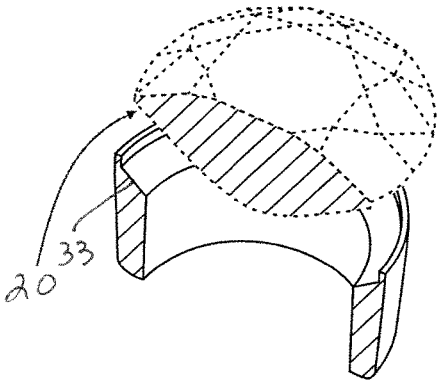
Figure 4C:
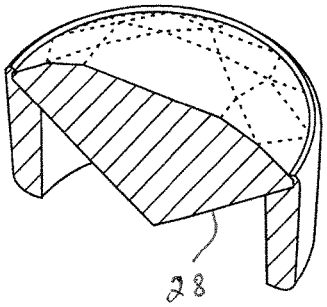

In the cross-sectional views of FIGS. 4A, 4B and 4C, the bezel setting 30 is shown to have a barrel style body 34 with an overall thickness which is indicated by numeral 36 and with a circumscribing sloped section 38 that extends downward toward the interior of the setting at an angle 33 leaving a protruding lip 37 whose thickness is a small fraction of the overall thickness, at least as compared to the prior art. The angle 33 is precisely matched to the pavilion angle of the diamonds being mounted. Typically, it is in the range of 41 to 45 degrees relative to the table plane of the diamond(s). The width (see the arrow 38) of the inclined section is between 0.40 to 0.70 mm, at least for the diamonds that have diameters of 2.00 to 8.00 mm.

Figure 6A:
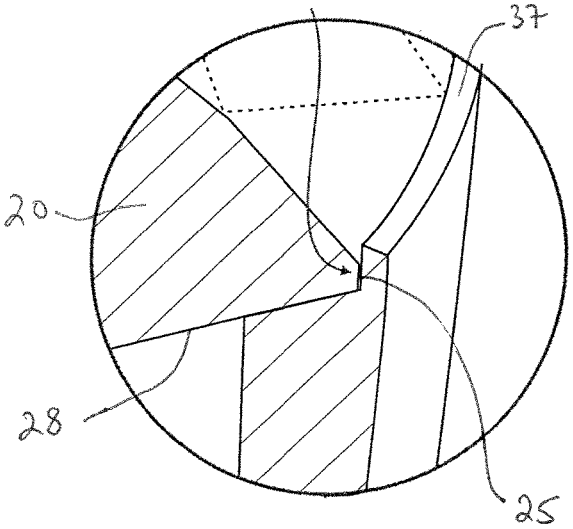
FIGS. 6A and 6B show method steps and details involved in the mounting of a gemstone into the bezel setting of the present invention.
Figure 6B:
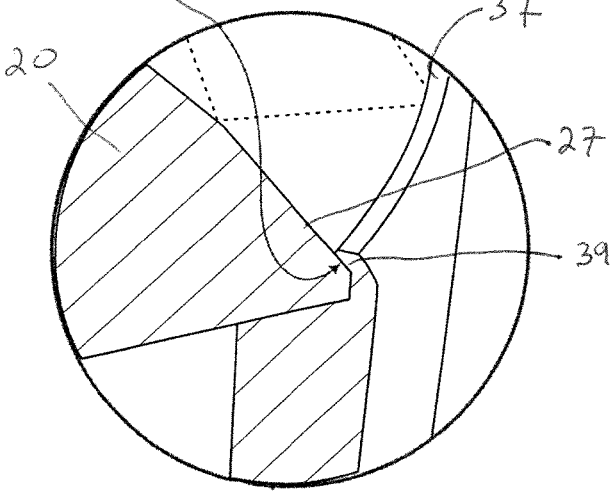

In a typical assembling of a piece of jewelry, the diamond 20 is lowered into the setting (FIG. 4B) with cullet end first, until it comes to rest in the setting as shown in FIG. 6A. Here, it is to be noted that the angle of inclination 28 of the pavilion 28 of the diamond 20 matches the angle 33 of the setting, with the lip 37 extending just a bit above the girdle 25 of the diamond 20. Once assembled, and as shown in FIG. 6B, the bent over portion 39 of the lip 37 covers a small portion, actually a tiny portion of the crown 29.

Figure 5:
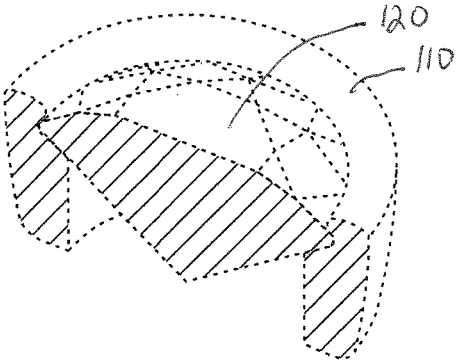
FIG. 5 shows in a cross-section a bezel mount of the prior art located adjacent to the bezel mount in accordance with the present invention.

Although only a small portion of the crown is covered, the fact that the angles are matched and that the material is forced over, produces an extremely sturdy holding on the diamond 20 which prevent the diamonds from ever falling out and which moreover protects the girdle from any damage by avoiding contact with any external forces. The tightness of the setting also prevents dirt from accumulating and penetrating into the setting and causing soiling of the pavilion of the diamond. Thus, a mere glance and comparison of FIG. 5 to FIG. 4C, which are rendered alongside, shows immediately the advantages of the present invention.

The table below is provided so it can be compared to the previous table to show the very significant improvements in visibility percentage of the present invention as compared to the prior art. For example, for a diamond that has a diametrical size from 5.0 to 8.0 mm, the ratio of the visibility is in the range of 95 to 98%. In general, the numbers are much improved. The improvement is obtained both from the top view and from the side view of the diamond.

Innovation "Seamless Bezel Setting"

| Size of Diamond (Girdle Diameter in mm) | Ratio of "Visible Diamond Portion to the Body of Metal Housing (Mounting)" in top view | Diamond Crown visibility % in side view |
|---|---|---|
| 2.0-3.0 mm | 85-90% | 35-55% |
| 3.0-5.0 mm | 90-95% | 55-75% |
| 5.0-8.0 mm | 95-98% | 75-85% |

The table below shows the diamond crown visibility percentage in side view, and contains a comparison to the prior art.

Diamond Crown visibility % in side view

| Size of Diamond (Girdle Diameter in mm) | Prior Art "Conventional Bezel Setting" | Innovation "Seamless Bezel Setting |
|---|---|---|
| 2.0-3.0 mm | 0% | 35-55% |
| 3.0-5.0 mm | 0-25% | 55-75% |
| 5.0-8.0 mm | 25-50% | 75-85% |

As described above, a typical method of setting a diamond in the seamless bezel of the present invention, one proceeds by preparing a bezel style setting having a wall thickness of 0.10 to 0.20 mm and a setting wall height of 0.2 to 0.3 mm for a majority of diamond diameters ranging from 2.0 to 8.0 mm. Thereafter, one uses a high accuracy/precision CNC machine to manufacture these seamless bezel mountings. Once the bezel has been produced, the diamond is placed, properly oriented in the seamless bezel mounting, with the cullet facing into the bezel. The next step involves installing the bezel setting and the diamond in a special die/jig fixture, an example of which is provided and described later with reference to FIGS. 7, 7A and 7B.

Figure 1B:
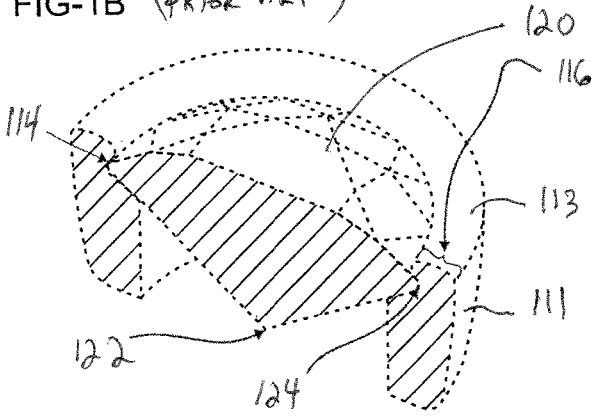
FIG-1B (PRIOR ART)
Figure 1C:
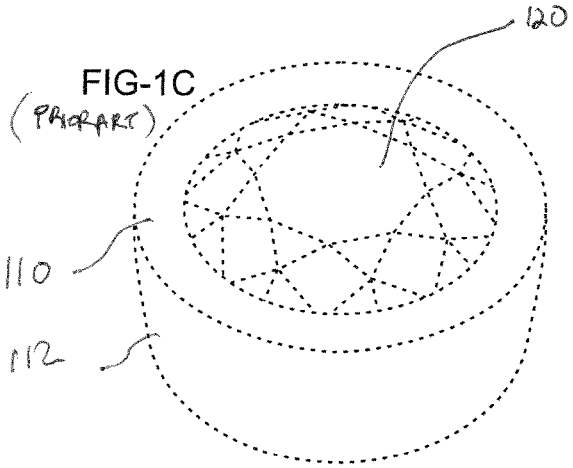
FIG-1C (PRIOR ART)
Figure 1D:
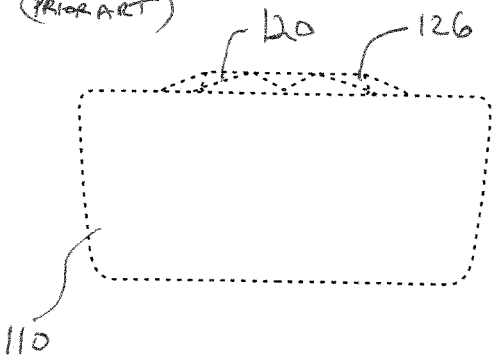
FIG-1D (PRIOR ART)

Comparing the bezel setting 30 of the present invention to the bezel setting 100 of the prior art, it will be evident to the person of skill in the art that in the bezel setting 100 of the prior art, the lip 113 has to have a thickness and a strength to withstand the forceful insertion of the diamond and therefore, has a width which is more than 50% of the thickness of the body 111 of the bezel setting. Also, because the girdle of the diamond has to be lodged in the groove 114, a substantial portion of the diamond gets covered over as seen in FIGS. 1B and 1D herein. In marked contrast, in the setting 30 of the present invention, the thickness of the lip 37 is on the order of 20% of the body thickness of the setting 30, or even smaller. In any event, the thickness can be on the order of 0.1 to 0.2 mm which is extremely thin and could not be used in the prior art because pushing a diamond into such a thin-walled lip would simply distort it outwardly permanently. The concept of a setting in which a jig or a fixture is required to bend over the lip has not been practiced in the prior art. In addition, the jig/fixture bends over and presses the lip 37 over the diamond causing it to fit precisely around the girdle and over a tiny portion of the crown of the diamond 20 in a manner not seen in the prior art, yet providing a very sturdy and visually appealing setting appearance that makes the setting almost invisible.

Using the special die/jig fixture, a thin bezel wall of 0.10 to 0.20 mm thickness is seamlessly converged around the girdle of the diamond. As a last step, the fully assembled and physically secured diamond is taken out from the die/jig/fixture and incorporated in final jewelry products, for example a ring, a pendant and the like.

Figure 7:
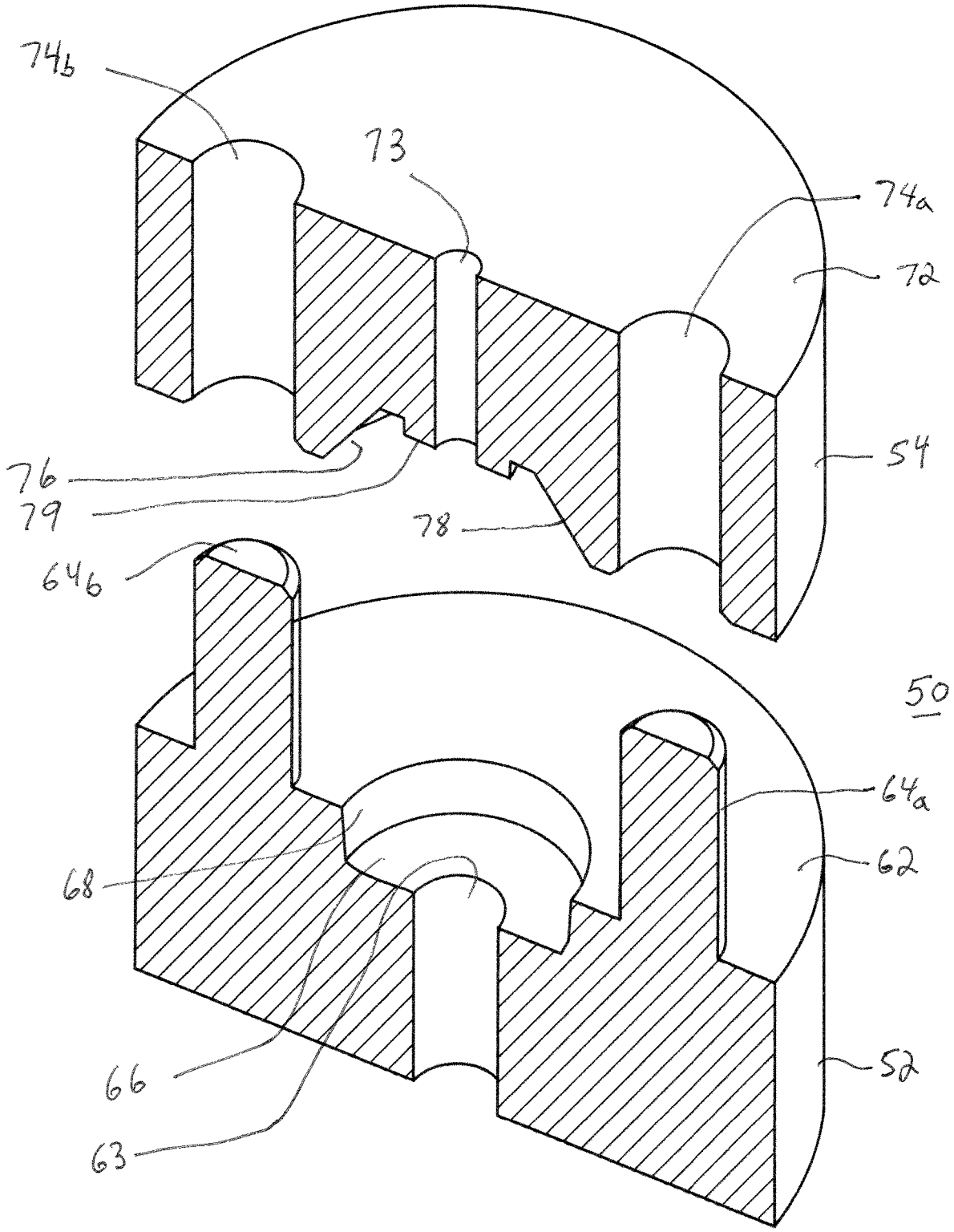
FIG. 7 shows a two-sided jig or a tool that can be utilized to mount a precious stone in the bezel setting of the present invention.

In one possible embodiment shown in FIGS. 7, 7A and 7B, the die/jig/fixture 50 comprises a jig base 52 and a jig presser 54 that are designed to very tightly interfit with one another as described below. The jig base 52 has a circular body with a flat top 62 and a pair of round and cylindrical guiding pins 64*a* and 64*b*. The jig base 52 defines a well 62 with a vertical circumscribing round wall 68 that accommodates the setting that includes the diamond to be set therein as described below. A central bore 63 is also included for the purpose of accommodating a portion of the pavilion and cullet of the diamond 20.

The jig presser 54 has a complementary shaped body 72 with guiding bores 74*a* and 74*b* which are dimensionally precisely matched to the sizes of the guiding pins 64*a* and 64*b*. The die pressing section 76 has an inclined, downwardly pressing wall 78 that is circularly shaped and whose function is to engage the lip 37 on the setting 30 as described below. The flats 79 are also provided and can be utilized to bear on the table of the diamond while the lip 37 is bent over the diamond as described below with reference to FIGS. 7A and 7B.

Figure 7A:
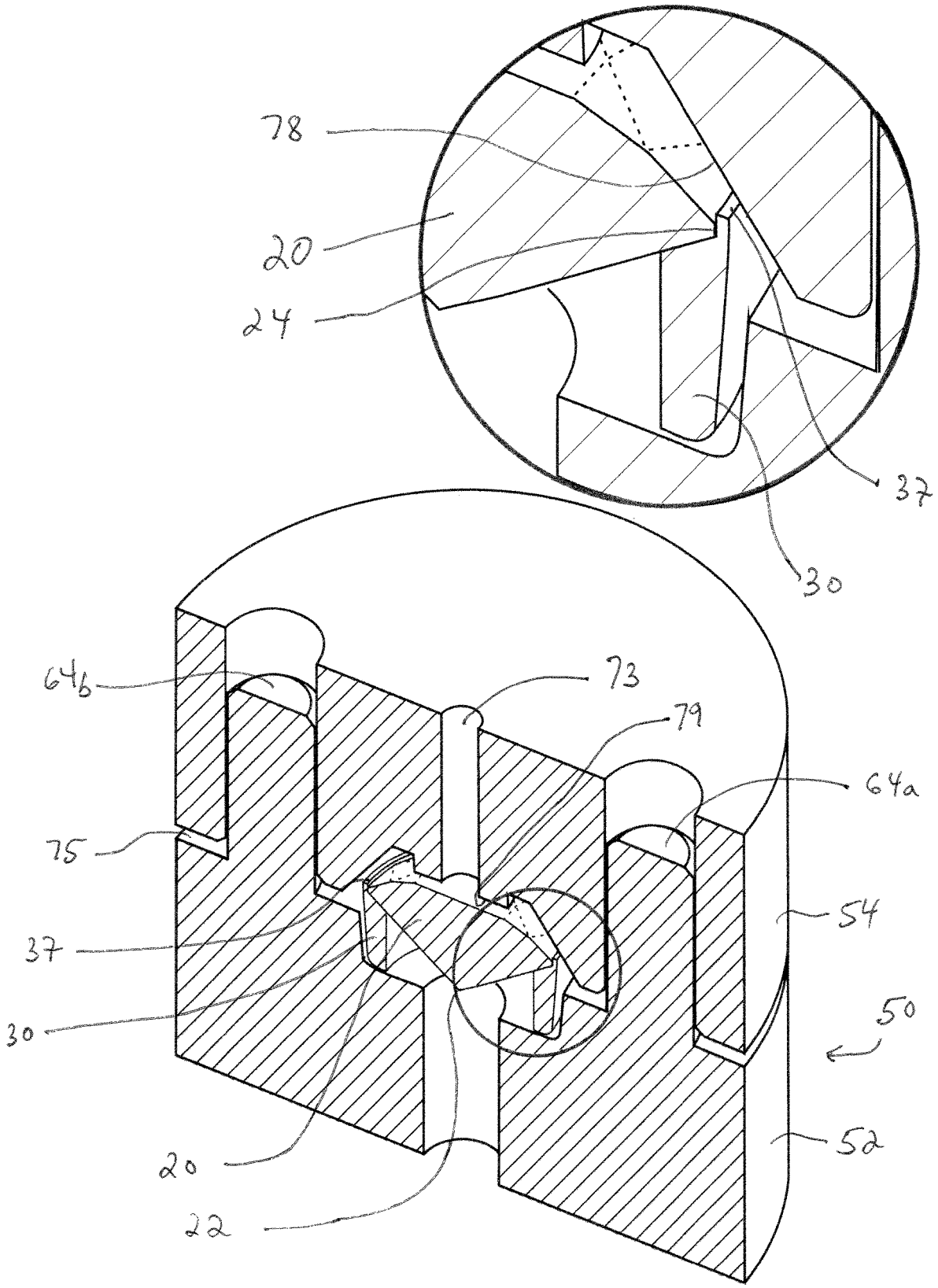
FIGS. 7A and 7B illustrate the steps of mounting a diamond into the setting of the present invention.
Figure 7B:
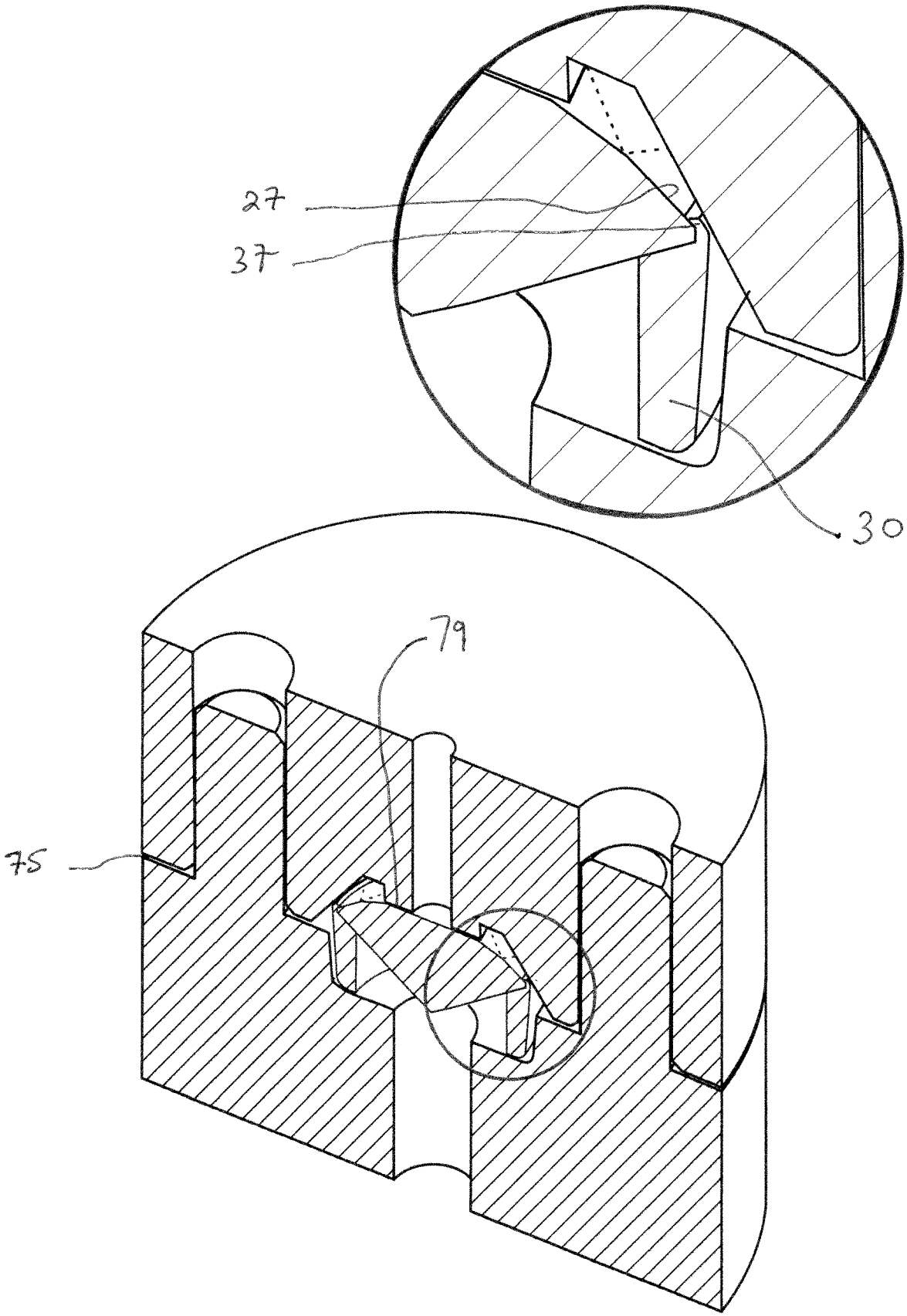

In FIG. 7A, the jig base 52 has been loaded with the setting 30 in which the diamond 20 has been installed with the lip 37 just or almost touching the diamond girdle, and with the jig presser 54 having been guided on the guiding pin 64*a* and 64*b*. As seen in the inset section of FIG. 7A, the inclining pressing surface 78 of the jig presser 54 just touches at this stage the lip 37 of the setting 30 leaving a gap 75 between the upper, jig presser 54 and the lower jig base 52. At this point, a pressing force is applied to the jig presser 54 which causes the inclined pressing surface 78 to bear on the lip 37 and tightly press it and wrap it around the girdle 24 and onto the crown of the diamond 20. As this occurs, and as seen in FIG. 7B, the lip 37 becomes bent over a tiny portion of the crown of the diamond 20 tightly wrapping it throughout its circumferential extension, thereby protecting the girdle from any contact with any force and against breakage and providing a very tight setting that will remain sturdy throughout the life of the diamond setting, thus achieving the ends of the present invention of providing a bezel setting that covers very little of the diamond and that provides an appearance that is almost similar to invisibly set diamonds and which avoids the drawbacks of the prior art previously described. The resulting set diamond has the appearance as in FIG. 4C, as more fully detailed in FIG. 6B.

While the present invention has been described relative to a bezel setting that is round, the principles of the invention are equally applicable to any shaped precious stone including precious stones that are square, rectangular, cushion shaped, pear shaped, heart shaped or any shape that is known in the field or has yet to evolve.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A bezel setting including a precious stone, comprising:

a bezel body having a circumscribing wall with a given body thickness, an upper surface sized to enable a corresponding pavilion surface of the precious stone to rest thereon, and a bendable lip substantially surrounding the upper surface of the bezel body, the lip having an interior surface shaped to be substantially matched and complementary to an exterior surface defining a girdle surface of the precious stone, and the lip has a thickness dimension that is substantially smaller than said body thickness of said bezel body and wherein said lip is made of a material that is compressible and bendable so it can be bent over to tightly wrap the girdle and slightly cover a crown region of the precious stone;

wherein the precious stone is a diamond; and wherein the lip extends over the crown region of the diamond so that it covers about 2%-5% of a diametrical size of the diamond, including for diamonds with a diametrical size in the range of 2.0 to 8.0 mm.

2. The bezel setting of claim 1, wherein the bezel body comprises one or more of gold, silver and steel.

3. The bezel setting of claim 1, wherein the lip has a thickness dimension in the range of 0.1 to 0.2 mm.

4. The bezel setting of claim 3, wherein the lip thickness is about 20% or less of the body thickness of the bezel body.

5. The bezel setting of claim 1, wherein the lip extends over a crown region of the diamond so that it covers less than 2% of a diametrical size of the diamond.

6. The bezel setting of claim 1, wherein the upper surface of the bezel body is inclined downward toward a center of the bezel setting.

7. The bezel setting of claim 6, wherein the angle of inclination of the upper surface is substantially matched to a corresponding angle of the pavilion region of the precious stone so that a portion of the pavilion region of the precious stone rests on the upper surface of the bezel setting and makes contact therewith.

8. The bezel setting of claim 7, wherein the angle of inclination is in the range of 41 to 44 degrees relative to a horizontal plane passing through the bezel body, as well as to a table surface of the precious stone when the precious stone is installed in the bezel setting.

9. A method of setting a precious stone, comprising:

providing a bezel setting having a bezel body with a circumscribing wall with a given body thickness, an upper surface sized to enable a corresponding pavilion surface of a precious stone to rest thereon, and a bendable lip substantially surrounding the upper surface of the bezel body, the lip having an interior surface shaped to be substantially matched and complementary to an exterior surface defining a girdle surface of the precious stone, and the lip has a thickness dimension that is substantially smaller than said body thickness of said bezel body and wherein said lip is made of a material that is compressible and bendable so it can be bent over to tightly wrap the girdle and slightly cover a crown region of the precious stone;

bending the lip of the bezel setting so that it tightly contacts the girdle region and slightly overlaps the crown region of the precious stone;

providing a jig fixture comprising a base and a pressing section;

placing the bezel setting with a precious stone placed in the bezel setting in the base of the jig fixture; and pressing the pressing section of the jig fixture onto the base, in a manner that causes the lip of the bezel setting to be bent around and over the girdle and the crown region of the precious stone, and in a manner that causes the lip to covers about 2%-5% of the diametrical size of the diamond.

10. The method of claim 9, wherein the diamonds being set in the bezel setting have a diametrical size in the range of 2.0 to 8.0 mm.

11. The method of claim 9, wherein the pressing section of the jig fixture has an inclining pressing surface that engages the lip and bends it when pressed thereon.

12. The method of claim 11, wherein the inclining pressing surface is disposed at an angle of about 41-44° relative to an angle associated a table surface of the precious stone.

13. The method of claim 12, wherein the base and pressing section of the jig fixture are guided to move relative to each other by guiding pins and corresponding guiding holes.

* * * * *